US006112672A

United States Patent [19]

Heil

[11] Patent Number: 6,112,672

[45] Date of Patent: Sep. 5, 2000

[54] SELECTIVELY ARRANGEABLE PALLET

[75] Inventor: Julius F. Heil, Sharpsburg, Ga.

[73] Assignee: Burnham Service Company, Inc., Atlanta, Ga.

[21] Appl. No.: 09/322,332

[22] Filed: May 28, 1999

[51] Int. Cl.[7] ..... B65D 19/44

[52] U.S. Cl. ..... 108/55.3; 108/54.1; 108/57.12

[58] Field of Search ..... 108/55.3, 51.11, 108/57.1–57.17, 57.18, 57.21, 57.3, 55.1, 54.1

[56] References Cited

U.S. PATENT DOCUMENTS

| | | | |
|---|---|---|---|
| Re. 32,344 | 2/1987 | Wind | 108/53.3 X |
| 2,973,931 | 3/1961 | Brown . | |
| 3,275,131 | 9/1966 | Erickson . | |
| 3,664,271 | 5/1972 | Wolder et al. . | |
| 3,677,200 | 7/1972 | Coccagna et al. | 108/53.5 |
| 3,696,761 | 10/1972 | Brown . | |
| 3,824,933 | 7/1974 | Lind . | |
| 3,868,915 | 3/1975 | Hafner . | |
| 3,995,749 | 12/1976 | Haskins | 108/55.1 X |
| 4,254,873 | 3/1981 | Cook, III et al. | 108/55.3 X |
| 4,267,780 | 5/1981 | Candella | 108/57.1 X |
| 4,316,419 | 2/1982 | Cupido . | |
| 4,597,338 | 7/1986 | Kreeger | 108/51.1 |
| 4,735,321 | 4/1988 | Day | 108/55.3 X |
| 4,930,632 | 6/1990 | Eckert et al. | 108/53.3 X |
| 5,094,175 | 3/1992 | Christie . | |
| 5,195,439 | 3/1993 | Harder . | |
| 5,546,872 | 8/1996 | Young . | |
| 5,582,113 | 12/1996 | Langenbeck . | |
| 5,651,463 | 7/1997 | Major et al. | 108/55.1 X |
| 5,911,179 | 6/1999 | Spiczka | 108/57.16 X |

*Primary Examiner*—Jose V. Chen
*Attorney, Agent, or Firm*—Jones & Askew, LLP

[57] ABSTRACT

A selectively arrangeable pallet for supporting conventional and unconventional loads and for reducing shock and vibrations on the loads. The selectively arrangeable pallet includes a base and a tray. The base and tray are selectively arrangeable in an overlaying relationship relative to each other in a nested configuration and alternatively in an expanded configuration. The tray is capable of being inverted relative to the base into the nested configuration to permit a first load-bearing surface of the tray to support the conventional loads and into the expanded configuration to permit a second load-bearing surface to support the unconventional loads. The second load-bearing surface of the tray includes a plurality of relatively spaced support pads for reducing shock and vibration. The support pads correspond with a plurality of relatively spaced recess in an upper surface of the base. The recesses extend through the upper surface of the base down into a plurality of relatively spaced support blocks extending from a lower surface of the base. The support blocks also reduce shock and vibration. In the nested configuration, the support pads nest within the recesses and, in the expanded position, the support pads support the unconventional loads.

22 Claims, 6 Drawing Sheets

SELECTIVELY ARRANGEABLE PALLET

FIELD OF THE INVENTION

The present invention relates to a pallet for supporting loads and, in particular, a selectively arrangeable pallet capable of being configured for both conventional and unconventional loads.

BACKGROUND OF THE INVENTION

Presently, there is a wide variety of pallets available for supporting loads above the ground and for transporting these loads from place to place. These pallets are adapted for use with material handling equipment such as forklifts. The forklifts facilitate the transportation of loads placed on the pallets from one location to another. To move a load from one location to another, the forklift is maneuvered to insert its forks into channels beneath the surface of the pallet.

Most commercially available pallets are typically made of wood. These conventional wooden pallets are cumbersome and are not easily moved or stacked without assistance. Recently, however, alternatives to these wooden pallets have appeared. Typically, these known alternative pallets are made of light-weight materials such as plastic.

These light-weight pallets, as well as the conventional wooden pallets, are designed for providing a flat, load-bearing surface for supporting conventional loads. These conventional loads have a solid, flat base which are well suited for resting upon the flat surface of a pallet. Some loads which typically do not have a flat bottom, such as copiers and ATMs, may be containerized in a primary carton, case, etc. By prepackaging the copiers and ATMs, their own packaging creates a flat bottom which enables them to be palletized as conventional loads.

However, some items which do not have a solid, flat base and can not be containerized are not able to be palletized. These items may be characterized as unconventional loads. Examples of unconventional loads include telephone switching stations, appliances, and office furniture. Typically, these unconventional items have levelers which extend outwardly from the base of the item. Because of the levelers, these items can not be properly supported upon the flat, load-bearing surface of most known pallets.

There are some pallets which have been modified or designed for receiving unconventional loads with levelers. However, these pallets are not well suited for receiving both conventional and unconventional loads. Typically, these pallets are primarily designed for only one type of load; either a conventional load or an unconventional load. Moreover, these known pallets are not suited for reducing shock and vibration transferred to the load during transportation and handling.

Manufacturers often utilize shock absorbing materials when palletizing conventional as well as unconventional loads. The shock absorbing material helps to support sensitive items such as electronics which normally could not be palletized on standard pallets due to the risk of damage from vibration and shock associated with normal transportation and handling. Different types of shock absorbing material may be utilized for different types of loads. However, when an item is to be shipped, the shock absorbing material is often included as part of the items packaging and not as an integral part of the pallet. The used shock absorbing material is then discarded and new shock absorbing material is required when palletizing the next load.

Accordingly, there is a need for a pallet that receives conventional and unconventional loads and provides shock and vibration resistance for conventional and unconventional loads.

BRIEF SUMMARY OF THE INVENTION

The present invention alleviates or solves the above-described problems in the prior art by providing a selectively arrangeable pallet for supporting conventional and unconventional loads and for transporting the loads by means of a lifting mechanism. The present invention seeks to provide an efficient apparatus and method of palletizing by selectively arranging the pallet into different configurations for supporting loads while also minimizing shock and vibration upon the loads.

In accordance with the present invention, this objective is accomplished by providing a selectively arrangeable pallet comprising a base and a tray. The tray includes first and second load-bearing surfaces which are operative for supporting the conventional and unconventional loads, respectively. The second surface includes a plurality of relatively spaced support pads extending from the second surface. The support pads, as well as the second surface, support the unconventional loads.

The base of the present invention includes upper and lower surfaces. A support structure extends from the lower surface of the base to elevate the upper surface above the ground. The upper surface and the support structure define a plurality of relatively spaced recesses which extend from the upper surface into the support structure.

The tray and base are selectively arrangeable in an overlaying relationship relative to each other between a nested configuration and an expanded configuration. The tray is capable of being inverted relative to the base into the nested configuration to permit the first load-bearing surface to support the conventional loads and into the expanded configuration to permit the second load-bearing surface and support pads to support the unconventional loads.

In accordance with one aspect of the present invention, the support structure is a plurality of relatively spaced support blocks. The support blocks at least partially define at least two parallel channels between the support blocks for selectively receiving and engaging the separated forks of a lifting mechanism.

Accordingly, an object of this invention is to provide an improved pallet for supporting a load that overcomes the aforementioned inadequacies of prior art pallets.

Another object of the present invention is to provide an improved pallet capable of supporting a wider range of items.

Still another object of the present invention is to provide a structurally simple and economical pallet for supporting a load.

Yet another object of the present invention is to provide a pallet for use with standard material handling equipment.

Still yet another object of the present invention is to provide a pallet capable of diminishing the damage associated with transportation and handling.

The foregoing has broadly outlined some of the more significant objects and features of the present invention. These should be construed to be merely illustrative of some of the more prominent features and applications of the intended invention. Many other beneficial results can be obtained by applying the disclosed invention in a different manner or by modifying the disclosed embodiments. Accordingly, other objects and a more comprehensive understanding of the invention may be obtained by referring to the detailed description of the preferred embodiment taken in conjunction with the accompanying drawings, in addition to the scope of the invention defined by the claims.

BRIEF DESCRIPTION OF THE DRAWINGS

Similar reference characters refer to similar parts throughout the several views of the drawings.

DETAILED DESCRIPTION

Figure 1:
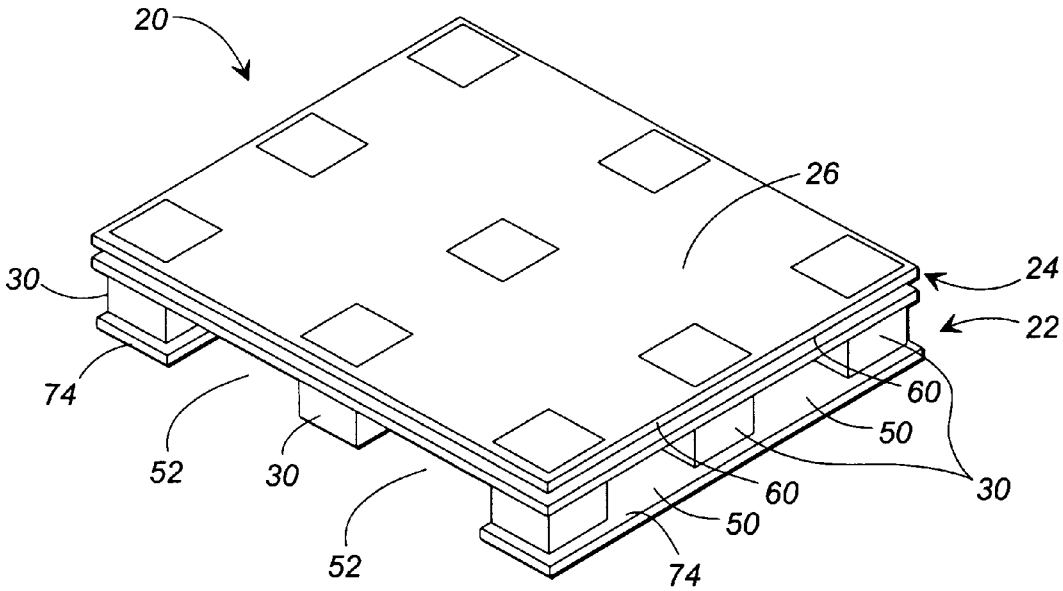
FIG. 1 is a front perspective view of one embodiment of a selectively arrangeable pallet in a nested configuration for supporting conventional loads.
Figure 2:
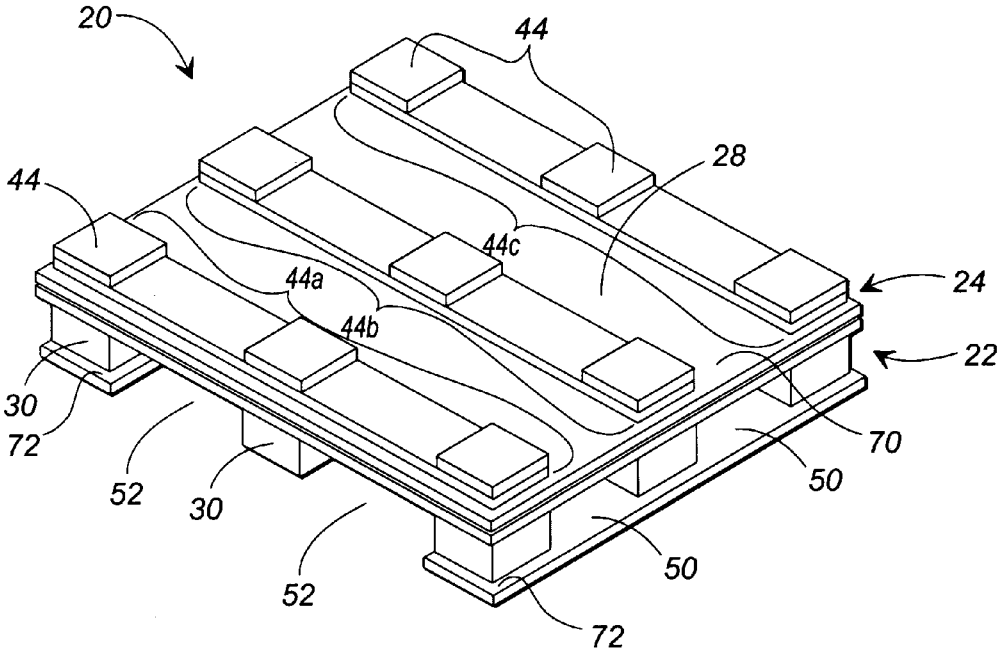
FIG. 2 is a front perspective view of one embodiment of the selectively arrangeable pallet in an expanded configuration for supporting unconventional loads.

With reference to the drawings, a new and improved pallet embodying the principles and concepts of the present invention and generally designated by the reference number 20 will be described. In accordance with one exemplary embodiment incorporating the present invention, FIG. 1 illustrates a front perspective view of a selectively arrangeable pallet 20 in a nested configuration for supporting conventional loads. FIG. 2, on the other hand, illustrates the selectively arrangeable pallet 20 in an expanded configuration for supporting unconventional loads. The pallet 20 may be converted from the nested configuration into the expanded configuration as described below.

Figure 3:
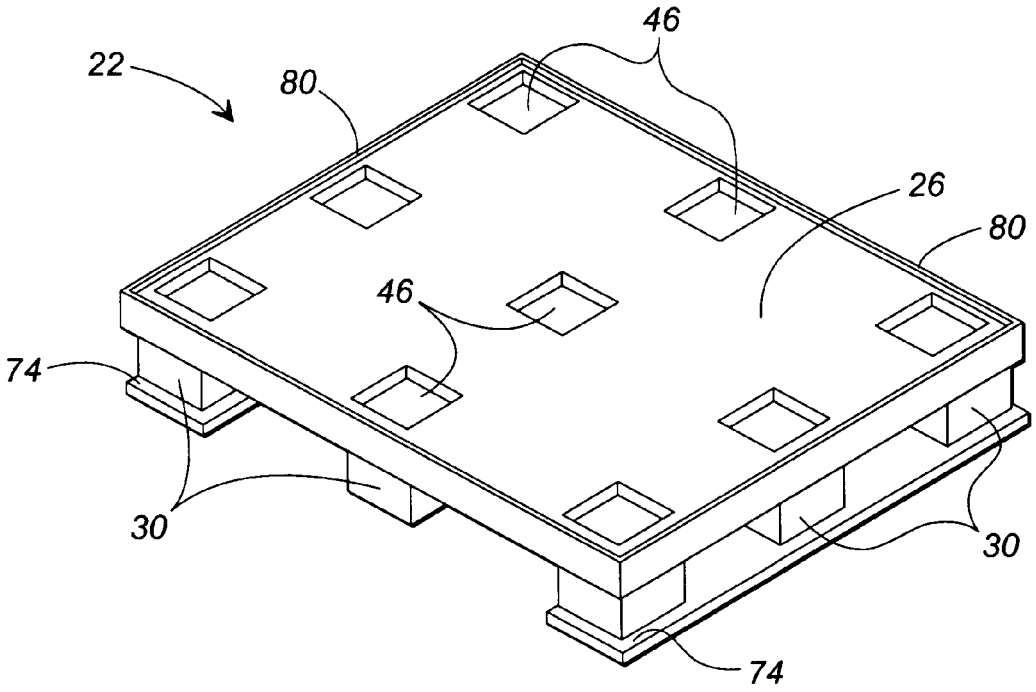
FIG. 3 is a perspective view of one embodiment of a base of the pallet of the present invention.
Figure 4:
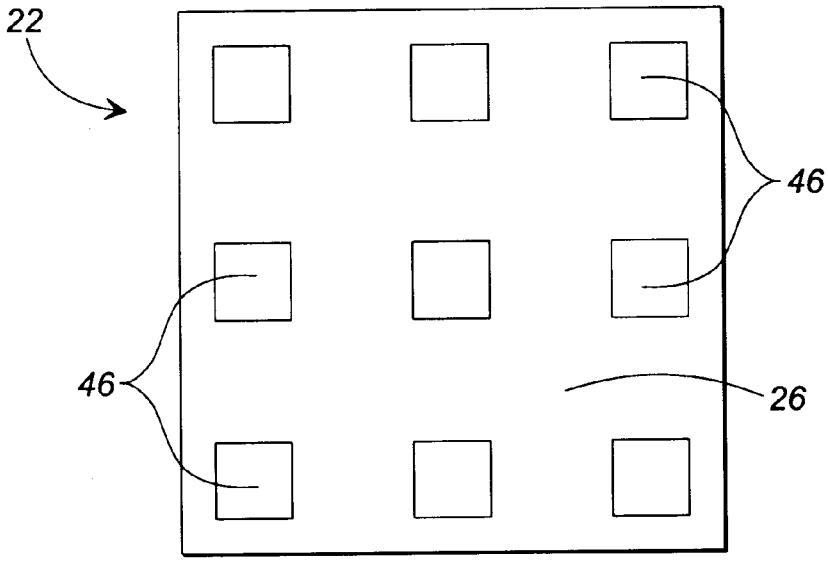
FIG. 4 is a top plan view of the base shown in FIG. 3.
Figure 5:
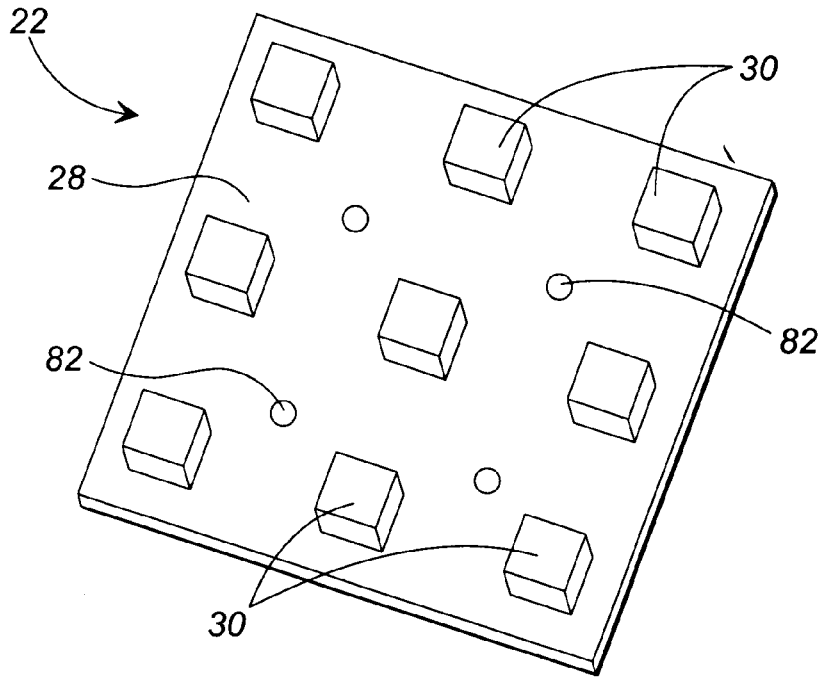
FIG. 5 is a bottom perspective view of one embodiment of the bottom of the base of the present invention.

The pallet 20 includes a base 22 and a tray 24. FIG. 3 illustrates a perspective view of the base 22. The base 22 includes an upper surface 26 and a lower surface 28 as shown in FIGS. 4 and 5, respectively. As best shown in FIG. 5, the base 22 further includes a support structure for elevating the upper surface 26 above the ground. Preferably, the support structure is a plurality of relatively spaced support blocks 30 extending outward from the lower surface 28.

Figure 6:
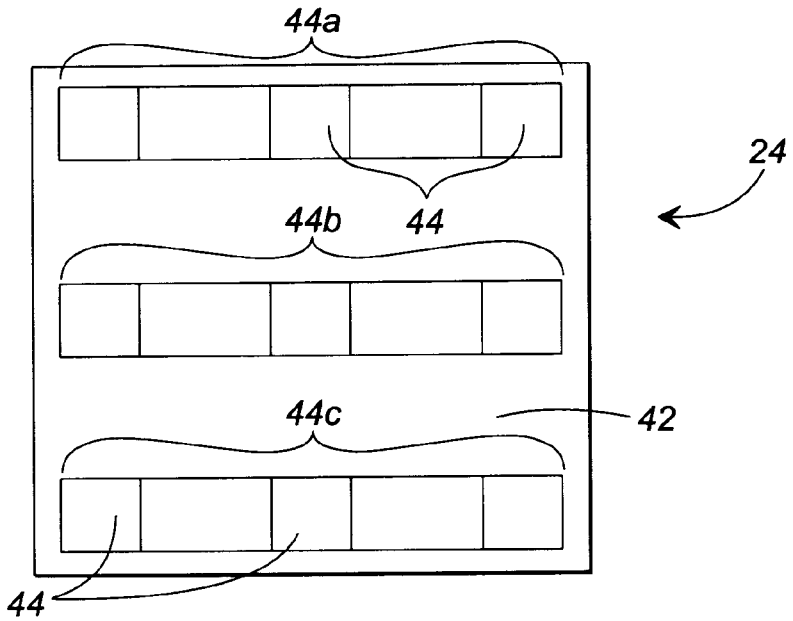
FIG. 6 is a top plan view of one embodiment of a tray of the pallet of the present invention.
Figure 7:
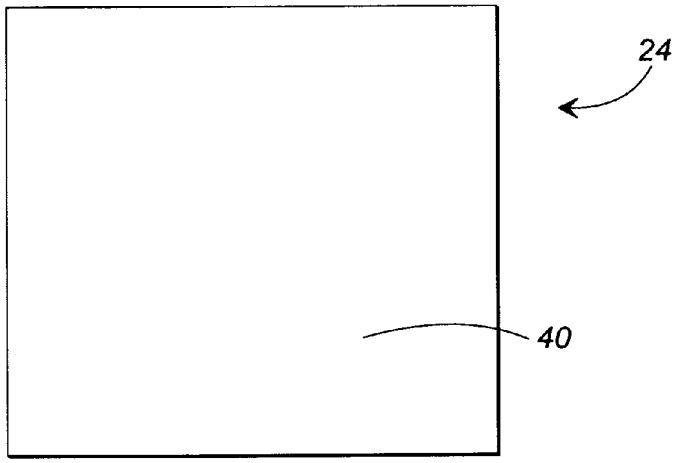
FIG. 7 is the bottom plan view of one embodiment of the tray shown in FIG. 6

As shown in FIGS. 6 and 7, the tray 24 includes a first load-bearing surface 40 and a second load-bearing surface 42. The first load-bearing surface 40 is substantially flat for receiving and supporting conventional loads. On the other hand, the second load-bearing surface 42 is configured for supporting unconventional loads.

Referring back to FIG. 2, the second load-bearing surface includes a plurality of relatively spaced support pads 44 which extend outward from the second load-bearing surface 42. In order to support the unconventional loads while in the expanded configuration, the support pads 44 come into contact with the base of the unconventional load while the levelers of the unconventional load are positioned between the support pads 44. Although the present invention primarily describes pallets 20 in the expanded position for supporting unconventional loads, the second load-bearing surface 42 may also support conventional loads as well as unconventional loads. This is because the flat bottom surface of conventional loads is still capable of being sufficiently supported by the support pads 44 themselves.

Figure 8:
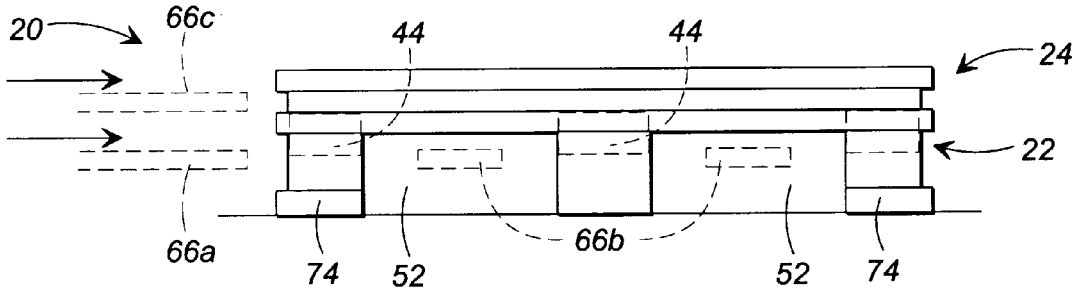
FIG. 8 is a front elevation view of the pallet in the nested configuration shown in FIG. 1.
Figure 11:
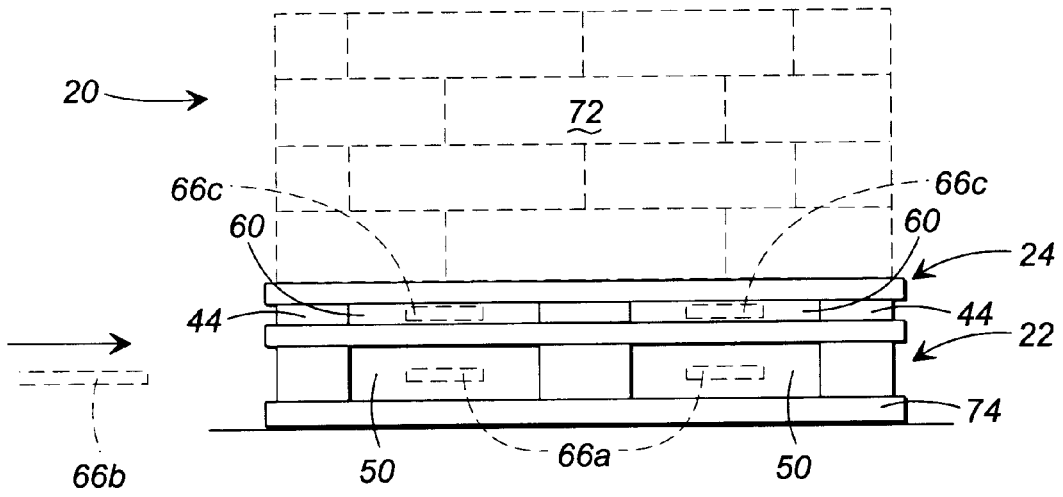
FIG. 11 is a side elevation view of the pallet in the nested configuration supporting a conventional load shown in phantom.

Referring back to FIG. 3, the base 22 further includes a plurality of relatively spaced recesses 46 which extend through the upper surface 28 and down into the support blocks 30. Each of the recesses 46 on the base 22 is sized for receiving one of the support pads 44 on the tray 24. In the nested configuration, the downward extending support pads 44 correspond with the recesses 46 and are nested in the recesses 46 as best shown in FIG. 8. However, while in the nested configuration, the second load-bearing surface 42 of tray 24 remains spatially separated from the upper surface of the base 22. FIGS. 8 and 11 best illustrate the separation between the upper surface 26 of the base 22 and the second load-bearing surface 42 of the tray 24.

In order to maintain the separation between the upper surface 26 and the second load-bearing surface 42, the support pads 44 are preferably interconnected with one another to form three separate groups of integral support pads. As shown in FIGS. 3 and 7, each of the three separate groups of integral support pads is generally designated by the reference numerals 44*a*, 44*b* and 44*c*, respectively. Because the portion by which the support pads are interconnected does not fit within the recesses when the pallet 20 is arranged into the nested configuration, the upper surface 26 and the second load-bearing surface 42 remain separated from one another.

Figure 9:
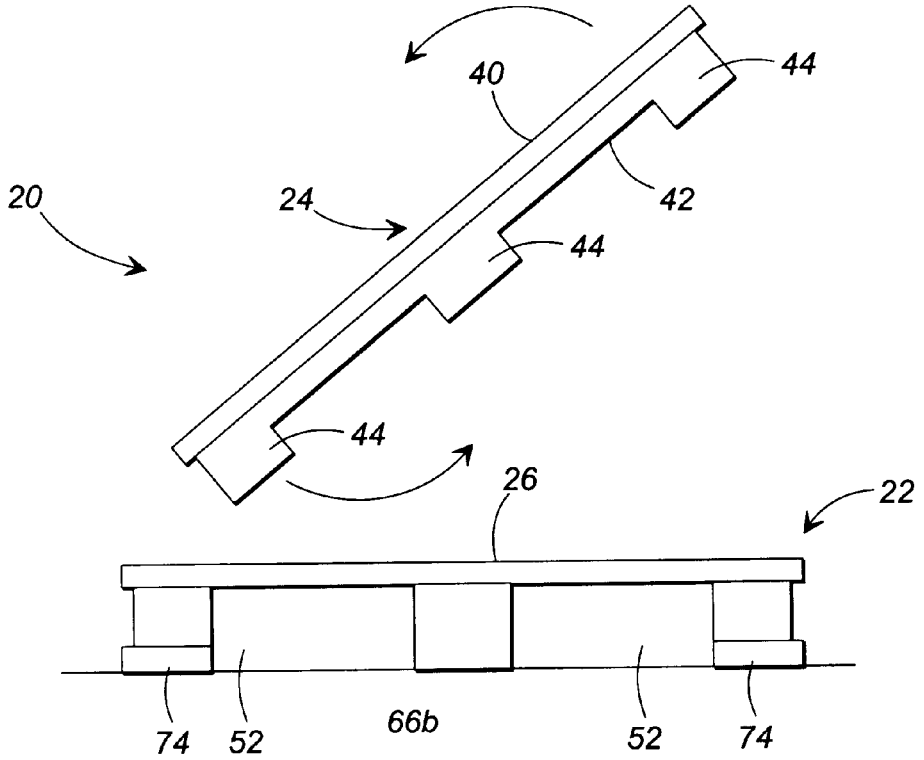
FIG. 9 is a front elevation view of the selectively arrangeable pallet of the present invention being converted from the nested configuration into the expanded configuration.
Figure 10:
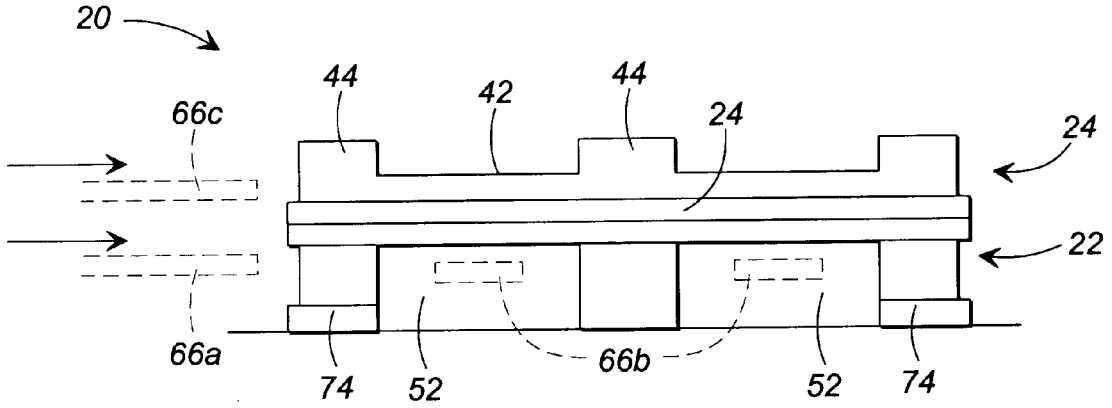
FIG. 10 is a front elevation view of the pallet in the expanded configuration shown in FIG. 2.

When viewing FIGS. 8–10 together, the manner in which the pallet 20 is arranged for supporting various loads is best illustrated. While in the nested configuration as shown in FIG. 8, the pallet 20 may be reconfigured into the expanded configuration by inverting the tray 24 relative to the base 22. FIG. 9, in particular, illustrates pallet 20 being converted by removing the tray 24 from the base 22, inverting the tray relative to base, and reorienting the tray to overlay the base. FIG. 10 then illustrates the pallet 20 in the expanded configuration after inverting the tray 24. As shown in FIG. 10, the support pads 44 extend upward in the expanded configuration. The pallet 20 may also be reconfigured back into the nested configuration by re-inverting the tray 24 relative to the base 22 and reorienting the tray 24 to overlay the base 22.

Referring back to FIGS. 1 and 2, the support blocks 30 define a longitudinal pair of parallel channels 50 and a transverse pair of parallel channels 52. The two pairs of channels, 50 and 52, are each configured for selectively receiving a pair of separated forks. Because the base 22 includes a longitudinal pair of channels 50, as well as a transverse pair of channels 52, the base 22 is configured for four-way entry of the separated forks of a lifting mechanism.

Still referring to FIGS. 1 and 2, the support pads 44 at least partially define a longitudinal pair of parallel channels 60. In the expanded position, the second load-bearing surface 42 further defines the channels 60 and, in the nested configuration, the upper surface 26 of the base 22, as well as the second load-bearing surface, further define the channels 60. In other words, the channels 60 are defined between the base 22 and tray 24 when the pallet 20 is in the nested configuration.

The pair of parallel channels 60 are also configured for selectively receiving a pair of separated forks between the support pads 44. In either the nested or expanded configurations, the channels 60 remain substantially unobstructed so that they are accessible by the separated forks. Because the tray only includes a longitudinal pair of channels 60, the tray is configured for two-way entry of the separated forks of a lifting mechanism. As best shown in FIG. 2, the portions which extend between the support pads 44 to define groups 44*a,* 44*b* and 44*c,* prevent the forks from entering in a transverse manner between the support pads 44.

Referring now to FIGS. 8 and 10–12, separated pairs of forks 66*a–c,* shown in phantom, are illustrated to show the various manners in which the pallet 20 may be accessed by a lifting mechanism. Forks 66*a* are positioned to be received between support blocks 30 in longitudinal channels 50, forks 66*b* are positioned to be received between support blocks 30 in transverse channels 52, and forks 66*c* are positioned to be received between support pads 44 in longitudinal channels 60. Receiving the forks, 66*a* or 66*b,* in the channels, 50 or 52, permits the tray 24 to be removed from the base 22 when the pallet 20 is in the nested configuration. Also, receiving forks 66*c* in channels 60 permits unconventional loads to be placed on or removed from the second load-bearing, surface 42 when the pallet 20 is in the expanded configuration.

Figure 12:
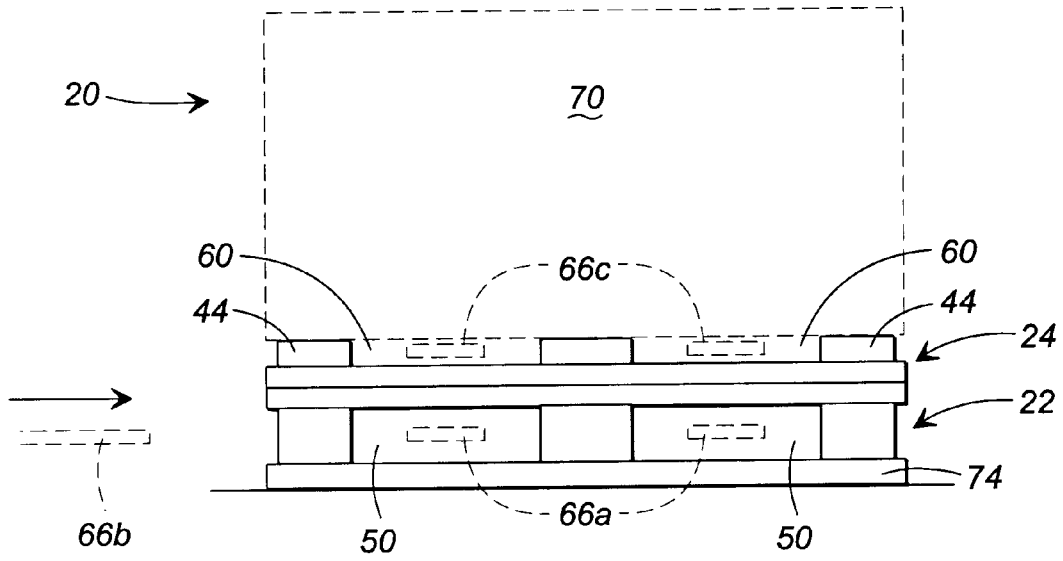
FIG. 12 is a side elevation view of the pallet in the expanded configuration supporting an unconventional load shown in phantom.

Note that in FIG. 11 that a conventional load 70, shown in phantom, is loaded or removed from the pallet 20 by positioning the separated forks 66*c* between the support pads 44 and underneath the tray 24. On the other hand, as shown in FIG. 12, an unconventional load 72, shown in phantom, is loaded or removed from the pallet 20 by positioning the forks 66*c* between the support pads 44 and above the tray 24.

The pallet 20, while loaded or unloaded with either type of load, may be transported from one location to another by positioning either forks 66*a* or forks 66*b* in the appropriate channels, 50 or 52. However, it is preferable to receive the forks 66*a* into longitudinal channels 50 rather than receive forks 66*b* into transverse channels 52. This is because the pallet 20 may tip off the forks 66*b* when being transported from one location to another. As shown in FIGS. 1–3, and 8–12, the base 22 of the pallet 20 may further include a plurality of elongated slats 74. The slats 74 prevent the loaded pallet 20 from tipping over. Each slat is connected to at least two support blocks 30. Preferably, the slats 74 substantially correspond in length with the pallet 20. In FIGS. 11 and 12 for example, the slats 74 run parallel to forks 66*b;* but are transverse to forks 66*a*. When the loaded pallet 20 begins to tip, the slats 74 will come into contact with the bottom of the forks 66*a* which will prevent the pallet 20 from tipping.

The choice of materials of which the base 22, tray 24, support blocks 30, and support pads 44 are made is primarily dependant on the type of load and the manner in which the load is attached to the pallet 20. The preferred manner for securing loads to the pallet 20 is described in greater detail in copending U.S. patent application having U.S. Ser. No. 09/322,410 filed on May 28, 1999 and entitled "Palletizing System, and Method for Palletizing a Load", the entire disclosure of which is incorporated herein by reference. The base 22 and tray 24 are preferably made of injection or blow molded plastic, but may be made of any other suitable material that facilitates resistance to shock and vibration. The base 22 is preferably honeycomb-shaped as shown in FIG. 5. Also, the support pads 44 and support blocks 30 are preferably made of any suitable material for absorbing shock and vibration. For example, if the load contains sensitive electronics, the support blocks and pads, 30 and 44, should be made of a material known for its resilience. Preferably, so that the pallet 20 is adaptable for use with a wide variety of loads, the support pads 44 and support blocks 30 are made of a rubber-based material.

The dimensions of the support blocks and pads, 30 and 44, are also dependant on the type of load. The support blocks and pads, 30 and 44, may be any shape. As best shown in FIG. 8, square support pads 44 substantially correspond in size with respective recesses 46 so that the support pads 44 are received in and nest within the recesses 46 when the pallet 20 is in the nested configuration. The extent which each recess 46 extends into each respective support block 30 and the extent which the distal end of each support pad 44 is nested within each recess 46 depends on the size of the load. In most instances, each support pad 44 and its respective recess 46 should extend into their respective support block 30 approximately one-half the height of the support block 30 as shown in FIG. 8. However, a portion of each support block 30 should remain solid so that the structural integrity of the support block 30 is maintained.

Also, the height of each support block 30 and support pad 44 depends on the type of load. Some loads may require highly compressible support pads in order to properly palletize the load and, therefore, require a larger support pad 44. For example, support pads 44 which are two inches in height can not be compressed as much as support pads 44 which are eight inches in height. While the pallet 20 is compressed to absorb shock and vibration, the upper surface 26 of the base 22 and the second load-bearing surface 42 of the tray 24 still remain spatially separated from one another so that forks may be received in channels 60.

Referring back to FIG. 3, the base 22 may further include a vertically extending flange portion 80 extending at least partially about the edge of the base 22. Preferably, however, the flange portion 80 extends entirely around the upper surface 26 of the base 22 as shown in FIG. 3. While in the expanded configuration, the outer edge of the tray 24 is surrounded by the flange portion 80. By surrounding the tray 24, the flange portion 80 prevents shear forces from separating the tray 24 from the base 22.

Alternatively, the tray 24 may be fastened to the base 22 with fasteners when the pallet is in the expanded configuration. In such case, both the base 22 and tray 24 would include a plurality of holes 82. FIG. 5 illustrates the base 22 having holes 82 positioned an equal distance apart. The holes 82 passing through the base 22 align with the holes 82 passing through the tray 24 when the pallet 20 is in the expanded configuration. Fasteners (not shown) are sized for being anchored in the aligned holes 82 in order to secure the base 22 and tray 24 together. While securing the base 22 and tray 24 together, the portion of the fastener extending beyond the lower surface 28 of the base 22 may be protected by the honeycomb structure of the base 22.

The use of the pallet 20 as described above constitutes an inventive method of the present invention in addition to the pallet 20 itself. In practicing the method of selectively arranging the pallet 20 for supporting conventional and unconventional loads above the ground and for transporting the loads, the steps include providing a base 22 having an upper surface 26 with a plurality of relatively spaced recesses 46. The method then includes the step of providing a tray 24 having first and second load-bearing surfaces, 40 and 42, and a plurality of relatively spaced support pads 44 extending outward from the second load-bearing surface 42. The method also includes the step of orienting the tray 24 to overlay the base 22 and to define a nested position such that the first load-bearing surface 40 is positioned for supporting a conventional load and the support pads 44 are received in the recesses 46. The method of the present invention then includes the step of inverting the tray 24 relative to the base 22 and reorienting the tray 24 to overlay the base 22 to define an expanded position such that the second load-bearing surface 42 and the support pads 44 are positioned for supporting an unconventional load. The method may further include the step of providing parallel channels 60 defined between the support pads 44 which remain substantially unobstructed in the nested as well as expanded positions.

Alternatively, the method of selectively arranging the pallet 20 for supporting conventional and unconventional loads above the ground and for transporting the loads may include the step of orienting the tray 24 to overlay the base 22 to provide the first load-bearing surface on the tray 24 for supporting conventional loads. The method then includes the step of nesting the plurality of relatively spaced support pads 44 extending downward from tray 24 into the plurality of corresponding, relatively spaced recesses 46 in an upper surface 26 of the base. Next, the method includes the step of inverting the tray 24 in relation to the base 22 and reorienting the tray 24 to overlay the base 22 such that the support pads 44 instead extend upward from the tray 24 and to provide a second-load bearing surface 42 on the tray 24 for supporting unconventional loads. While providing the first and second load-bearing surfaces, 40 and 42, the method may then includes the step of concurrently providing at least two parallel channels 60 at least partially defined by the support pads 44 for selectively receiving and engaging the separated forks.

The present invention has been illustrated in great detail by the above specific examples. It is to be understood that these examples are illustrative embodiments and that this invention is not to be limited by any of the examples or details in the description. Those skilled in the art will recognize that the present invention is capable of many modifications and variations without departing from the scope of the invention. Accordingly, the detailed description and examples are meant to be illustrative and are not meant to limit in any manner the scope of the invention as set forth in the following claims. Rather, the claims appended hereto are to be construed broadly within the scope of the invention.

What is claimed is:

1. A selectively arrangeable pallet for supporting conventional and unconventional loads above the ground and transportable with a lifting mechanism, said selectively arrangeable pallet comprising:

a tray having first and second load-bearing surfaces, said first and second surfaces operative to support the conventional and unconventional loads, respectively, said second surface having a plurality of relatively spaced support pads extending from said second surface for also supporting the unconventional loads; and a base having upper and lower surfaces and a support structure extending from said lower surface, said upper surface and said support structure defining a plurality of relatively spaced recesses extending from said upper surface into said support structure, whereby said tray and said base are selectively arrangeable in an overlaying relationship relative to each other in a nested configuration wherein the plurality of relatively spaced support pads are nested within the plurality of spaced recesses and alternatively in an expanded configuration wherein the plurality of relatively spaced support pads extend outwardly from the pallet, said tray capable of being selectively arranged relative to said base into said nested configuration to permit said first load-bearing surface to support the conventional loads and alternatively into said expanded configuration to permit said second load-bearing surface and said support pads to support the unconventional loads.

2. The selectively arrangeable pallet of claim 1 wherein said support structure at least partially defines at least two parallel channels for selectively receiving and engaging a pair of laterally separated forks of the lifting mechanism.

3. The selectively arrangeable pallet of claim 2 wherein said parallel channels defined by said support structure include two longitudinal channels and two transverse channels for selectively receiving and engaging the separated forks.

4. The selectively arrangeable pallet of claim 2 wherein said support structure comprises a plurality of relatively spaced support blocks, and wherein said parallel channels are defined between said support blocks.

5. The selectively arrangeable pallet of claim 4 further comprising a plurality of elongated slats, each said slat connected to at least two support blocks.

6. The selectively arrangeable pallet of claim 5 wherein said slats substantially correspond in length with said pallet.

7. The selectively arrangeable pallet of claim 1 wherein said second surface of said tray is spatially separated from said upper surface of said base when said pallet is in said nested configuration.

8. The selectively arrangeable pallet of claim 1 wherein said support pads of said tray substantially correspond in size with said recesses of said base such that said support pads are received in and nest within said recess when said pallet is in said nested configuration.

9. The selectively arrangeable pallet of claim 1 further comprising means for fastening said tray to said base when said pallet is in said expanded configuration.

10. The selectively arrangeable pallet of claim 9 wherein said tray and pallet each comprise a plurality of holes therethrough, said holes in said base aligning with said holes in said tray when said pallet is in said expanded position, and said fastening means comprises a plurality of fasteners sized for being anchored in said holes.

11. The selectively arrangeable pallet of claim 1 wherein said base further comprises a vertically extending flange portion extending at least partially about the edge of said base, said flange portion for preventing shear force from separating said tray from said base when said pallet is in said expanded configuration.

12. The selectively arrangeble pallet of claim 1 wherein said support pads at least partially define at least two parallel channels between said support pads for selectively receiving and engaging a pair of laterally separated forks of the lifting mechanism.

13. The selectively arrangeable pallet of claim 12 wherein said parallel channels defined between said support pads are further defined between said tray and said base such that the forks may be received therein to permit said tray to be removed from said base when said pallet is in said nested configuration.

14. The selectively arrangeable pallet of claim 12 wherein said parallel channels defined between said support pads permit unconventional loads to be placed on and removed from said second load-bearing surface when said pallet is in said expanded configuration.

15. The selectively arrangeable pallet of claim 12 wherein said parallel channels defined between said support pads remain substantially unobstructed when said pallet is arranged in either said nested or expanded configurations such that said parallel channels between said support pads are accessible by the separated forks.

16. The selectively arrangeable pallet of claim 12 wherein said parallel channels defined by said support pads are two longitudinal channels.

17. A selectively arrangeable pallet for supporting conventional and unconventional loads above the ground and transportable with a lifting mechanism having a pair of laterally separated forks, said selectively arrangeable pallet comprising:

a tray having first and second load-bearing surfaces, said first surface operative to support conventional loads, said second surface including a plurality of relatively spaced apart support pads extending outwardly from said second surface, said second surface and said support pads operative to support unconventional as well as conventional loads; and a base having upper and lower surfaces, a plurality of relatively spaced support blocks extending outwardly from said lower surface, said upper surface and said support blocks defining a plurality of relatively spaced recesses extending from said upper surface into said support blocks, said tray capable of being selectively arranged relative to said base in a nested configuration wherein the plurality of relatively spaced support pads are nested within the plurality of spaced recesses and alternatively in an expanded configuration wherein the plurality of relatively spaced support pads extend outwardly from the pallet, said tray and said base in an overlaying relationship relative to each other when in both said configurations, and said support pads of said tray substantially corresponding with said recesses of said base such that said support pads are received in and nest within said recesses when said pallet is in said nested configuration.

18. The selectively arrangeable pallet of claim 17 wherein said support pads at least partially define at least two parallel channels between said support pads for selectively receiving and engaging the separated forks, said parallel channels remaining substantially unobstructed when said pallet is arranged in either said nested or expanded configurations, whereby the forks may be received therein to permit said tray to be removed from said base when said pallet is in said nested configuration and to permit loads to be placed on and removed from said second load-bearing surface when said pallet is in said expanded configuration.

19. A method of selectively arranging a pallet for supporting conventional and unconventional loads above the ground and for transporting the loads by means of a lifting mechanism, said method comprising the steps of:

providing a base having an upper surface and a plurality of relatively spaced recesses in said upper surface;

providing a tray having first and second load-bearing surfaces and a plurality of relatively spaced support pads extending outward from said second load-bearing surface;

orienting said tray to overlay said base and to define a nested position such that said first load-bearing surface is positioned for supporting a conventional load and said support pads are received in said recesses; and inverting said tray relative to said base and reorienting said tray to overlay said base to define an expanded position such that said second load-bearing surface and said support pads are positioned for supporting an unconventional load.

20. The method of claim 19 further comprising the step of providing parallel channels defined between said support pads which remain substantially unobstructed in said nested and expanded positions.

21. A method of selectively arranging a pallet for supporting conventional and unconventional loads above the ground and transportable with a lifting mechanism, said method comprising the steps of:

orienting a tray to overlay a base to provide a first load-bearing surface on said tray for supporting conventional loads;

nesting a plurality of relatively spaced support pads extending downward from said tray into a plurality of corresponding, relatively spaced recesses in an upper surface of said base; and inverting said tray in relation to said base and reorienting said tray to overlay said base such that said support pads instead extend upward from said tray and to provide a second-load bearing surface on said tray for supporting unconventional loads.

22. The method of claim 21 wherein, while providing said first and second load-bearing surfaces, the method further comprises the step of concurrently providing at least two parallel channels at least partially defined by said support pads for selectively receiving and engaging a pair of laterally separated forks of the lifting mechanism.

* * * * *